US005538451A

United States Patent [19]

Sherer

[11] Patent Number: 5,538,451

[45] Date of Patent: Jul. 23, 1996

[54] BALLOON DETONATORS

[76] Inventor: Ronald B. Sherer, 20816 Amber Hill Ct., Germantown, Md. 20874

[21] Appl. No.: 515,276

[22] Filed: Aug. 15, 1995

[51] Int. Cl.[6] ..... A63H 37/00

[52] U.S. Cl. ..... 446/14; 446/220; 446/484; 446/397; 472/56

[58] Field of Search ..... 446/14, 220, 484, 446/397, 398; 472/51, 53, 56, 134

[56] References Cited

U.S. PATENT DOCUMENTS

| | | | |
|---|---|---|---|
| 5,183 | 2/1993 | Chen | 446/220 |
| 1,727,706 | 9/1929 | Hitt | 472/484 |
| 1,915,721 | 6/1933 | Diaz | 472/56 |
| 2,383,390 | 8/1945 | Jacobs | 446/220 |
| 2,856,732 | 10/1958 | Weismantel . | |
| 4,292,999 | 10/1981 | Szollmann | 446/220 |
| 4,425,117 | 1/1984 | Hugemann . | |
| 4,638,207 | 1/1987 | Radice | 446/220 |
| 4,932,915 | 6/1990 | Boris et al. | 446/220 |
| 5,117,344 | 5/1992 | Perez | 446/220 |

*Primary Examiner*—Robert A. Hafer
*Assistant Examiner*—Jeffrey D. Carlson
*Attorney, Agent, or Firm*—Ronald B. Sherer

[57] ABSTRACT

A detonator for exploding toy balloons without the use of explosive or flammable materials is disclosed which comprises an electrically conductive filament which becomes electrically heated and explodes the balloon.

20 Claims, 2 Drawing Sheets

BALLOON DETONATORS

FIELD OF THE INVENTION

The present invention relates to amusement or so-called "toy" balloons, and more particularly, to detonators for exploding inflated toy balloons for entertainment purposes.

BACKGROUND

Balloons are one of the most widely used materials for both decorating and providing amusement at celebrations ranging from political conventions and major league athletic events to individual parties in the home. Many millions of toy balloons are used each year as decorations and as amusement devices in balloon drops from the ceilings of convention centers, as helium-filled balloons rising into the sky, and in being exploded with a loud "bang" with or without confetti exploding outwardly in all directions. However, prior devices for exploding toy balloons for amusement purposes have been limited to bulky electromechanical devices which puncture the balloon with a needle actuated by an electromagnet, or to explosive charges, such as so-called "squibs," which require a charge of explosive material. Both forms of detonators are relatively heavy, expensive and are frequently unreliable in exploding the balloons; not to mention the significant safety hazards of using charges of explosives in close proximity to large audiences of spectators or family members at home.

SUMMARY

The present invention provides detonators for exploding amusement balloons which are purely electric and which do not require either a heavy and expensive electromagnet, nor any explosive charge. The present detonators are based upon the discovery that amusement balloons, both of the latex and Mylar® type, may be exploded in a highly reliable manner, by the application of a very small, localized and focused amount of heat, and that such localized and focused heat may be generated and applied to the balloon by a low voltage electrical circuit applied to a thin filament without the use of any explosive material of any type.

These and other objects and advantages of the present invention will become more fully apparent from the following description of several preferred embodiments of the invention as schematically shown for purposes of illustration in the following figures of drawing.

DETAILED DESCRIPTION

Figure 1:
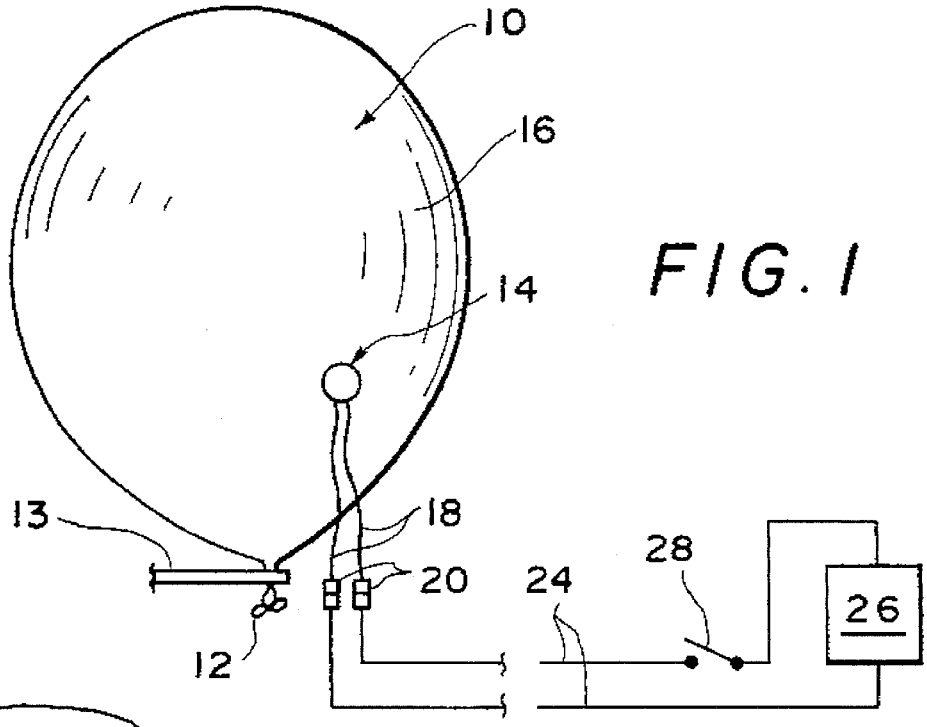
FIG. 1 is a schematic illustration of an inflated balloon with an attached detonator of the present invention.

FIG. 1 schematically illustrates an inflated balloon 10 which may or may not contain confetti, party favors, candy, etc., to be scattered in all directions upon the explosion of the balloon. Balloon 10, which may be of the latex or Mylar type, includes a sealed stem 12 and balloon 10 may be mounted in a support 13 of any type. Of course, it will be readily understood that the latex type of balloon is substantially preferred for the present invention since the walls of inflated latex balloons can be expanded to a much greater degree than Mylar balloons such that latex balloons explode with a loud "bang" which adds to the amusement value.

FIG. 1 further illustrates one form of detonator 14 of the present invention attached to the outer surface of balloon wall 16, by attachment means to be described hereafter, and detonator 14 includes a pair of electrically conductive leads 18. Leads 18 are connected through a pair of conventional wire connectors or couplings 20 to an electrical circuit 22 comprising circuit wires 24, a power source 26 and a switch schematically illustrated at 28. Connectors 20 are provided so that the balloons and attached detonators may be mounted at any desired height or location, such as at the ceiling, after which the detonator leads 18 may be electrically connected to circuit 22, the latter of which may be at a location remote from that of the balloons. While the details of several preferred power sources will be described hereinafter, it will be understood at this point that, upon manual or automatic closure of switch 28, a predetermined amount of electrical current is applied to detonator 14, which current is transformed into focused, or highly localized heat by detonator 14. This focused/localized heat is applied directly to the expanded wall 16 of the balloon so as to cause the balloon to explode virtually instantaneously upon closure of switch 28.

Figure 2:
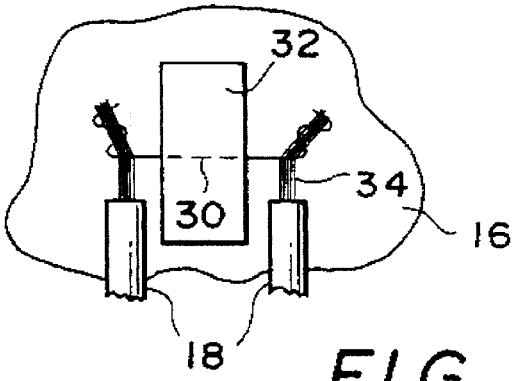
FIG. 2 is a schematic illustration of a simplified embodiment of a detonator according to the present invention attached to a balloon.

One simplified form of detonator of the present invention is illustrated in FIG. 2 wherein numeral 30 indicates a thin, uninsulated filament wire secured to wall 16 of the balloon such as by a piece of adhesive tape 32. Filament wire 30 may be of any metallic composition so long as it is electrically conductive, such as for example, conventional copper or aluminum wire of the electrical type. However, depending upon the type and output current capacity of the power source, filament wire 30 should be of 20 gauge or higher gauge; ie, 20 gauge or smaller diameter such as 22–26 gauge, for example. The opposite end portions of filament wire 30 are electrically connected to the bare ends 34 of insulated leads 18 by any suitable means such as, for example, by twisting the end portions of filament wire 30 about the bare ends of leads 18 as illustrated. Alternatively, it will be understood that filament 30 may be connected to the bare ends of the leads by any conventional method of connecting wires such as, for example, by soldering, clipping, crimping, clamping, stapling or molding the connected portions of the wires in plastic, rubber or other insulating material. While filament 30 should be of 20 gauge or lesser diameter as stated above, leads 18 and circuit wires 24 should be of greater diameter than 20 gauge such as, for example, 18–14 gauge. In this manner, when switch 28 is closed, the current flow will not cause appreciable or significant heating of the leads or circuit wires. However, such current flow will cause substantial and instantaneous heating of filament 30, and such heating of the filament immediately ruptures wall 16 of balloon 10 such as to instantly explode the balloon. Depending upon the current discharge capacity of power source 26, as will be further described, filament 30 may become so hot as to glow, and even so hot as to melt the thin filament with or without the production of an electrical spark as the melted ends of the filament become separated by a small gap. However, as the result of many tests, it has been discovered that it is not at all necessary to reach temperatures at which the filament wire glows, much less temperatures required to melt or rupture the wire. While the production of such temperatures; ie, by the selection of the power source and the particulars of the filament wire, certainly ensure that the balloon wall will be ruptured in a highly reliable manner, it has been discovered that, due to the highly focused and localized application of the heat to the balloon wall, balloons may be reliably exploded by temperatures of the filament which are significantly below that required for the filament to glow, much less to become melted or ruptured. As a result, the detonator of the present invention may be designed, by the gauge and composition of the filament relative to a given power source, so as to be re-useable many times without being destroyed. Alternatively, the detonator of the present invention may be designed so as to be used only once, as in the case of conventional squibs, but at a substantially lower cost and without the hazards of employing any explosive charge. In brief, the detonator of the present invention employs only heat, not explosives, and it ruptures the balloon wall and reliably explodes the balloon by creating a deliberate and controlled short circuit by virtue of using a very thin filament of short length which focuses the heat of the short-circuited filament in a small area of the balloon wall and thereby weakens and ruptures the balloon by virtue of localized heating alone.

Figure 3A:
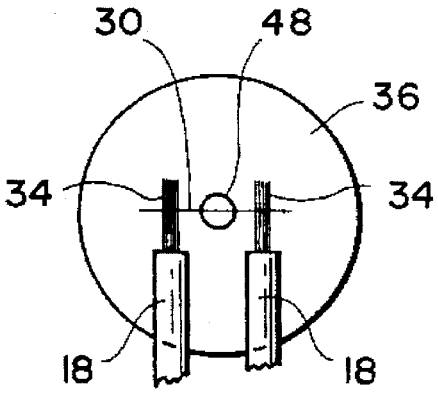
FIGS. 3*a–b* schematically illustrate one embodiment of the detonator of the present invention including first and second support layers securing the filament therebetween.
Figure 3B:
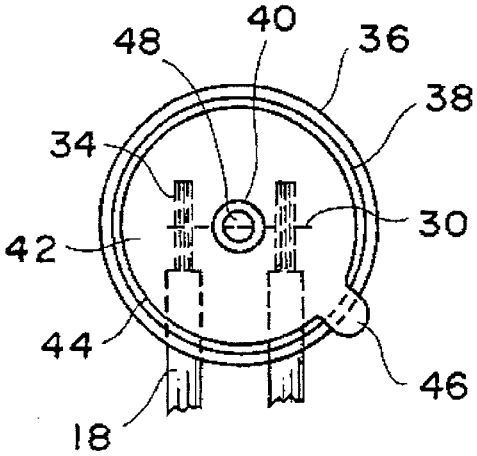

While the detonator embodiment of FIG. 2 is extremely simple and of ultra-low cost, the twisted filament wire and leads require the individual application of adhesive strips to the fine filament wire and to the balloon wall which may be awkward and/or time-consuming in setting up large balloon displays. Accordingly, a second embodiment of the detonator is illustrated in FIGS. 3*a–b* wherein numeral 36 indicates a support layer which may be composed of virtually any material such as, for example a thin piece of rigid or flexible plastic, cardboard, rubber or plastic foam, or plastic or cloth tape. In this embodiment, filament 30 may be placed on support layer 36, and the bare ends 34 of leads 18 may be placed over or under the end portions of the filament wire in electrical contact therewith as illustrated in FIG. 3*a*. A second support layer 38 may then be placed over layer 36 and the filament and leads so as to form a sandwich construction. Second layer 38 is preferably of the same size as first support layer 36, and is illustrated as being of smaller diameter particularly for purposes of clarity in distinguishing the two layers in FIG. 3*b*. Second support layer 38 includes a centrally-located hole 40 whereby at least the central portion of filament 30 is exposed, and one or both of support layers 36, 38 may be joined together by an adhesive layer on its or their facing surface(s) so that the two support layers adhere to each other when pressed together, thereby securing filament 30 and lead wires 34 therebetween. Alternatively, support layers may be joined by other connection means such as, for example, clips, rivets, clamps, staples or other fastener means.

With respect to preferred shapes and dimensions, support layers 36, 38 are preferably circular, but may be square, rectangular, oval-shaped or of other shape and, preferably, layers 36, 38 may have diameters in the order of 0.5 to 2.0 inches and the diameter of hole 40 may be in the order of ⅛ to ½ inch, although larger diameters of the support layers and hole 40 may be preferred for larger balloons such as, for example, balloons having diameters over 2 feet. It will be understood that layer 38 is placed against wall 16 of the balloon, such that it is sometimes referred to hereinafter as the "forward" support layer, and layer 36 is sometimes referred to hereinafter as the "rearward" support layer.

With respect to the manner of attaching the detonator of the present invention to the wall of the balloon, forward support layer 38 is placed against the outer surface of balloon wall 16 so that the central portion of filament 30 exposed by hole 40 is in direct engagement with the surface of the balloon wall, or spaced therefrom only by the thickness of forward support layer 38, which may be in the range of 1/64 or less to ⅛ of an inch depending upon the type of material used for forward support 38. A piece of adhesive tape similar to tape piece 32, may then be placed over the back of rearward support layer 36 and secured to the balloon in order to hold the front face of forward support layer 38 tightly against the balloon wall. However, instead of using a separate piece of tape, it is substantially preferred that forward support layer 38 have an adhesive layer 42 whereby the composite detonator may be simply pressed against wall 16 of the balloon, and adhere thereto, without resorting to the use of a separate piece of adhesive tape. Adhesive layer 42 may be one side of forward support layer 38 which may be composed of double-sided adhesive tape, for example, or adhesive coating 42 may be an adhesive applied to the forward side of forward support layer 38 which may be of the other compositions stated herebefore. In any event, it is further preferred that, for purposes of packaging and shipment, adhesive layer 42 be covered by a readily removable cover layer 44 which may be simply peeled off prior to attaching the detonator to the balloon wall as, for example, by grasping tab 46 and peeling cover layer 44 from adhesive layer 42. In a further preferred embodiment, and particularly if forward support layer is relatively thick, such as if it is a piece of double-sided plastic foam tape or other material over 1/16 of an inch thick, for example, it is preferred to provide a small spacer layer 48 between rearward support layer 36 and filament 30. Spacer 48 may be a thin layer of plastic or other material, and it forces the center of the filament outwardly into direct contact with balloon wall 16.

Figure 4:
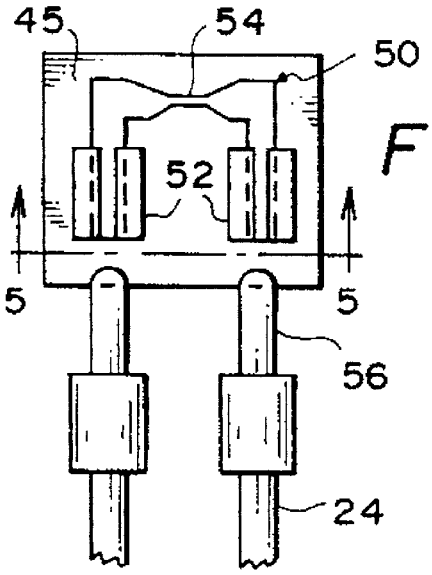
FIGS. 4–5 are schematic illustrations of a further embodiment of the detonator of an integral, one-piece construction.
Figure 5:
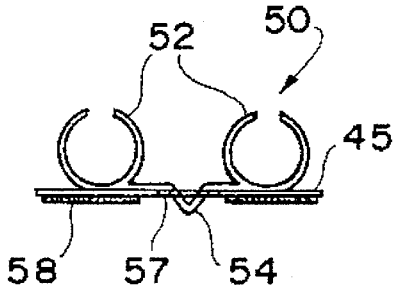

A further preferred embodiment of the detonator of the present invention is illustrated in FIGS. 4–5 wherein a one-piece filament 50 is shown as comprising a generally U-shaped, or H-shaped, element having a pair of leg portions 52 and a horizontal portion 54 of substantially reduced cross-section. One-piece filament 50 may be stamped out of a thin sheet of electrically conductive metal, such as cooper or aluminum composition, with the thickness of the sheet and the circumference of crimped leg portions 52 being such as to carry the current without appreciable heating as previously described. At the same time, the reduced cross-section of filament portion 54 is designed so as to be equivalent to the cross-section of 20 gauge wire or less, as previously described, whereby thin filament portion 54 becomes heated to the temperature required to rupture the balloon wall. It will be understood that, after filament 50 is stamped from a flat sheet, leg portions 52 may be crimped to be circular or U-shaped as shown in FIG. 5, such that removable male connectors 56 may be inserted into the leg portions so as to removably connect circuit wires 24 directly to filament 50.

With regard to adhering filament 50 to a balloon, such may be accomplished in the FIG. 4–5 embodiment by use of an adhesive strip similar to strip 32. However, it is preferred that filament 50 be mounted on a support layer 45 of rectangular, circular or other shape, and support layer 45 preferably includes a hole 57 through which the thin filament portion may extend into direct contact with the balloon wall 16. Support layer 45 may include an adhesive layer on the forward side, and it will be understood that adhesive layer may be covered for shipment purposes by a readily removable, peel-off layer (not shown) such as peel-off layer 44 previously described. This embodiment is advantageous in that reduced portion 54 comprising the filament portion to be heated, and possibly melted, can be manufactured at very low cost as a single piece with integral, one-piece leg portions 52, the latter of which may removably connect the filament portion directly to circuit wires 24. Thus, whenever filament portion 54 becomes heated to the point of melting and rupturing, only the small, inexpensive one-piece filament element 50 and support layer 45 need be replaced, thereby eliminating the replacement of leads 18 and connectors 20.

Figure 6:
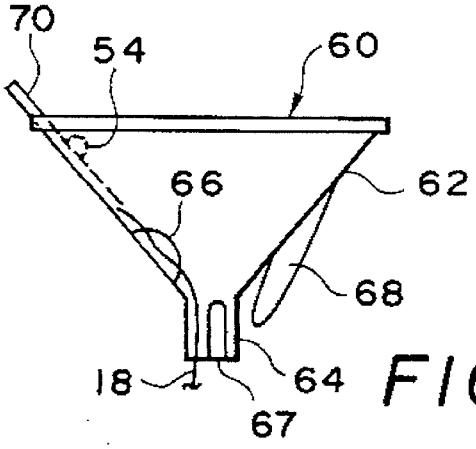
FIGS. 6–8 are schematic illustrations showing the manner of connecting the detonator to a conventional balloon support cup.

The foregoing description has described several preferred embodiments of detonators which may be utilized regardless of the manner in which the balloons are supported. However, it is known that, in professional balloon displays involving many or hundreds of balloons, conical-shaped plastic cups are frequently utilized. FIG. 6 illustrates one embodiment of the use of the present invention in connection with such conventional support cups. Numeral 60 indicates the support cup which has a conical section 62 and a cylindrical section 64. Cups of this type generally have one or more holes 66 for pulling the twisted stem of the balloon through the wall of the cup and frictionally securing the stem between the cup and a semi-flexible projection 68, or through slots 67 in the cup. A detonator 70 of the present invention having a filament 30 or 54 may be secured, permanently or removably, directly to the upper, inner wall of the conical portion of the cup by glue, double- or single-sided adhesive tape, clips, staples or rivets, or other known connector means. Detonator 70 may be any one of the embodiments previously described, and that the detonator is secured to cup 60 instead of directly to the balloon wall, and leads 18 or circuit wires 24 may extend from the detonator either through the inside of the cup, as shown, or may extend outside of the cup, if preferred, so as not to interfere with the stem of the balloon extending through cylindrical portion 64. One of the advantages of this embodiment is that the support cup supports both the balloon and the detonator, and the detonator may be integral with the cup, or the detonator may be a readily removable and replaceable element such as filament element 50 just described.

Figure 7:
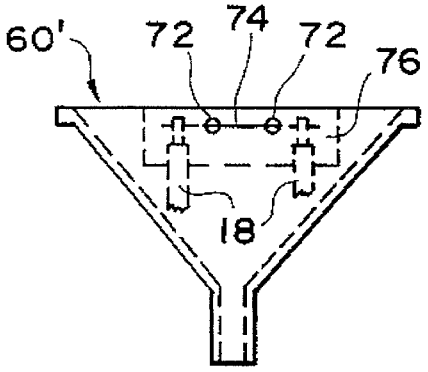

A further embodiment of support cup and filament is illustrated in FIG. 7 where a filament wire 74 is shown as inserted through a pair of small holes 72 located in the upper portion of the conical wall of the cup; the filament wire extending across the holes on the inside surface of the cup wall. The end portions of the filament wire on the outside of the cup wall may be connected to the bare ends of insulated leads 18 by twisting the filament around the bare ends, or by a piece of adhesive tape 76 affixed to the outside of the cup wall, or by any other conventional means of connecting wires as previously described. One of the advantages of this embodiment is that only filament wire 74 and tape 76, or other connector means, need be replaced at such time as the filament melts and ruptures.

Figure 8:
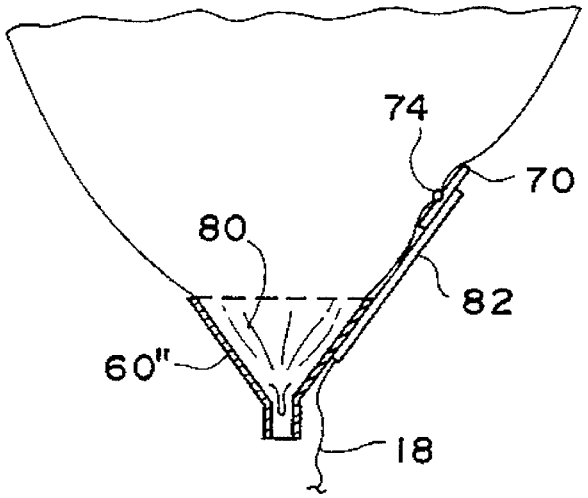

In the foregoing descriptions of the FIG. 6 and 7 embodiments, it will be understood that conventional balloon support cups 60 and 60' may have a vertical height of only 1.5 to 2 inches, and that for balloons larger than a nominal 9 inch diameter, or for any size of balloon where the balloon has a thickened wall portion adjacent the stem, such as portion 80 shown in FIG. 8, it is preferred to use either a cup of longer axial length, or to mount the detonator on an extension 82 as shown in FIG. 8. In this manner, the detonator may be positioned so as to contact the balloon wall at a point where the wall is not thickened and, therefore, is fully expanded. This ensures that the balloon will explode suddenly as opposed to requiring a time delay to rupture the thickened wall, or possibly only melt a small hole in the thickened wall which would cause the balloon to deflate but not explode. Such extension may be a strip of any material, but it is preferably a thin plastic strip which is connected to the cup wall for easy removal, such as by a clip, detent, removable or permanent adhesive, or other connection means. Similarly, detonator 70 may be of any of the types previously described, and it may be permanently connected to the upper end of extension 82 by gluing, riveting, etc., or may be removably secured as previously described. In this regard, it is preferred that cup 60" and extension 82 be reusable, and only detonator 70 need be replaced at such time as the filament becomes ruptured.

Figure 9:
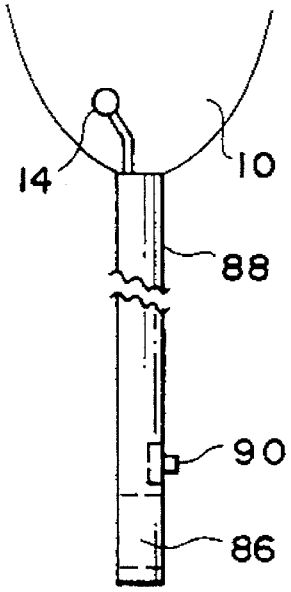
FIG. 9 schematically illustrates a balloon on a hollow stick with a power source and switch mounted in the hollow stick.

With regard to the type of power sources suitable for the present invention, standard 115 V, 60 cycle AC current may be used. However, extensive tests have unexpectedly discovered that DC voltages from an AC/DC transformer as low as 1.5 volts DC are sufficient to heat filament wires of 20 gauge and smaller to a temperature sufficient to rupture and explode conventional latex and Mylar balloons. In addition, it has been discovered that a rechargeable battery having a nominal charged voltage of 3.7 volts DC is also sufficient. Thus, it has been discovered that very low voltage and safe power sources may be used, and that, as shown in FIG. 9, a battery 86 small enough to be contained in a hollow, hand-held stick 86 with a switch 90 may be used and carried in the hand in a completely portable manner. For large displays including many balloons to be exploded simultaneously, it is preferred to use an AC/DC transformer or a larger battery such as a rechargable 12 V automotive or marine battery. In either event, low voltage power sources may be used which are highly portable, or completely portable, and are completely safe but entirely sufficient to heat the very small, thin filament of the detonator as described hereinabove.

From the foregoing description of several preferred embodiments of the invention, it will be apparent that numerous variations will become obvious to those skilled in the art of exploding balloons. Thus, it is to be understood that the foregoing description is intended to illustrate the principles of the invention, rather than being exhaustive of the many possible embodiments thereof, and that it is not intended that the invention be limited other than as expressly set forth in the following claims interpreted under the doctrine of equivalents.

What is claimed is:

1. A detonator for exploding an amusement balloon having an exterior surface comprising:

(a) an electrically conductive filament having a predetermined cross-section and an exposed portion;

(b) a pair of electrically conductive wires having their ends electrically connected to said filament at spaced-apart portions of said filament, the cross-section of said wires being substantially larger than the predetermined cross-section of said filament such that said filament becomes heated upon the flow of electrical current therethrough; and (c) means for mounting said detonator on a balloon with said exposed filament portion immediately adjacent and sufficiently close to said exterior surface such that said heated filament explodes the balloon.

2. The balloon detonator of claim 1 wherein said filament has a cross-section equivalent to a gauge in the order of 20 to 30 gauge.

3. The balloon detonator of claim 1 wherein said filament has a cross section equivalent to less than 20 gauge.

4. The balloon detonator of claim 1 wherein said filament and said wire ends are positioned between first and second support layers, and including means for connecting said first and second support layers to each other to support said filament therebetween.

5. The balloon detonator of claim 4 wherein said means for connecting said first and second support layers comprise an adhesive between said layers.

6. The balloon detonator of claim 4 wherein said second support layer includes a hole, and said hole is positioned adjacent at least a portion of said filament whereby the heat of said filament may pass through said hole.

7. The balloon detonator of claim 1 wherein said mounting means comprise an adhesive.

8. The balloon detonator of claim 4 wherein said means for mounting includes adhesive means for attaching said support layers and said filament to a balloon.

9. The balloon detonator of claim 8 wherein said adhesive means comprise a layer of adhesive on one of said layers, and a readily removable cover layer covering said layer of adhesive.

10. The balloon detonator of claim 1 wherein said filament extends between a pair of electrical connectors, said electrical connectors being of a size and shape to connect to said pair of wires.

11. The balloon detonator of claim 10 wherein said filament and said pair of electrical connectors comprise different portions of a one-piece electrically conductive element, the cross-section of said filament portion being substantially smaller than the cross-section of said connector portions.

12. The balloon detonator of claim 11 wherein said means for mounting includes adhesive means for attaching said one-piece electrically conductive element to a balloon.

13. The balloon detonator of claim 1 including a support cup having a conical wall portion for receiving and supporting a balloon, and means for attaching said filament to said wall portion.

14. The balloon detonator of claim 13 further including an extension element having first and second end portions, first connector means for connecting said first end to said cup wall, and second connector means for connecting said filament to said second end of said extension element.

15. The balloon detonator of claim 1 in combination with a power source for generating the flow of current through said filament, and circuit means including at least one switch for electrically connecting said power source to said filament when it is desired to explode a balloon.

16. The balloon detonator of claim 15 including readily separable connector means for removably connecting said pair of wires to said circuit means.

17. The balloon detonator of claim 15 wherein said power source comprises an AC to DC transformer.

18. The balloon detonator of claim 15 wherein said power source comprises at least one DC battery.

19. The balloon detonator of claim 15 wherein said power source comprises at least one rechargeable DC battery.

20. The balloon detonator of claim 18 wherein said battery has a voltage of 1.5 to 12 volts DC.

* * * * *